US006167658B1

(12) United States Patent
Weiner

(10) Patent No.: US 6,167,658 B1
(45) Date of Patent: Jan. 2, 2001

(54) BOAT WEATHER COVER AND VENTILATION SYSTEM

(76) Inventor: William J. Weiner, 28 Railway Ave., Campbell, CA (US) 95008

( * ) Notice: Under 35 U.S.C. 154(b), the term of this patent shall be extended for 0 days.

(21) Appl. No.: 09/407,155

(22) Filed: Sep. 28, 1999

(51) Int. Cl.[7] ..... E04H 9/00; B63B 17/00

(52) U.S. Cl. ..... 52/2.11; 52/2.17; 52/2.25; 114/361

(58) Field of Search ..... 52/2.11, 2.16, 52/2.17, 2.19, 2.25; 114/361, 211

(56) References Cited

U.S. PATENT DOCUMENTS

| | | | | |
|---|---|---|---|---|
| 2,390,986 | * | 12/1945 | Burns | 114/361 |
| 4,712,501 | * | 12/1987 | Whitley | 114/211 |
| 4,991,363 | * | 2/1991 | Randmae | 52/2.11 |
| 5,566,512 | | 10/1996 | Page | 52/2.16 |
| 5,759,098 | | 6/1998 | Jarnot | 454/275 |
| 5,918,972 | * | 7/1999 | Van Belle | 362/480 |

* cited by examiner

*Primary Examiner*—Carl D. Friedman
*Assistant Examiner*—Kevin McDermott
(74) *Attorney, Agent, or Firm*—Robert Charles Hill

(57) ABSTRACT

A weather cover for a boat comprises a fabric cover that completely covers the boat while floating in the water. The cover is gathered tight above the waterline. An air-duct fan inside the cover draws in clean dry air from outside through a filtered vent and a connecting flexible air duct. Such fan runs on electricity provided by shore power, the boats electrical system, or solar panels. The exhaust air is directed through another vent through the cover. The intake cover vent is filled with a replaceable filter foam material. In both vents, a louver opening is directed downward to prevent rain or water spray from entering. The fan need only keep the air inside the boat dry over the long term. The fan therefore may run continuously, or as power is available, e.g., during daylight when the sun is shining. In alternative embodiments, the pressurized air from the fan is valved through to inflate internal support chambers that will keep the cover away from the top surfaces of the boat even after the fan has stopped.

8 Claims, 1 Drawing Sheet

BOAT WEATHER COVER AND VENTILATION SYSTEM

BACKGROUND OF THE INVENTION

1. Field of the Invention

The present invention relates to protective weather covers and ventilation systems in general, and more particularly to keeping boats free of mildew, rust, and other corrosion that can be caused when a cover would otherwise trap moist air inside.

2. Description of Related Art

Circulating clean, dry air is the best way to keep any structure or vehicle free from the harmful effects of rust and mildew. Moist air trapped inside will corrode metal parts over time, and fabrics and other organic materials will grow mildew. Boats are especially susceptible to such problems because they operate on the water and are often left moored on water under a cover. Such water bodies are a nearby source of water that can evaporate and then condense as liquid water inside. Sometimes boats are also stored on trailers under a cover.

Rain and sun can also quickly deteriorate a boat, so many small pleasure boats are routinely covered to keep out the weather. But such covers can trap water vapor inside and cause the other damage mentioned.

An air-supported enclosure for a car that protects the car from weather and the effects of trapped water vapor is described by Reis Randmae in U.S. Pat. No. 4,991,363, issued Feb. 12, 1991. An electric fan is used to draw in outside air through a filter housing and inflate the enclosure. The filter housing covers a filter material and has an open intake end that points down. Rain and snow cannot enter.

A vent for a flexible boat cover is described by Frank R. Jarnot, in U.S. Pat. No. 5,759,098, issued Jun. 2, 1998. A rigid triangular patch is sewn or welded to a flexible cover with an open end that points down. Holes in the flexible cover are opened up underneath the triangular patch to allow air to move in and out. Louvers at the bottom opening of the triangular patch provide a breathable screen barrier.

An inflatable storage chamber for vintage cars and antiques is described by George Page in U.S. Pat. No. 5,566,512, issued Oct. 22, 1996. An electric fan draws in outside air and pressurizes the inside of the chamber. An adjustable air vent is used to control the flow of air through the chamber to provides a dry, non-humid condition so the protected items will not deteriorate.

SUMMARY OF THE INVENTION

An object of the present invention is to provide a cover that will keep out the weather and yet still circulate clean dry air through the interior to help prevent mildew and rust.

Briefly, a weather cover embodiment of the present invention for a boat comprises a fabric cover that completely covers the boat whenever it is stored. The cover is gathered tight above the waterline. A fan inside the cover draws in clean dry air from outside through a filtered vent. Such fan runs on electricity provided by municipal power, the boats electrical system, or solar panels. The exhaust air is directed through another vent through the cover. The intake cover vent is filled with a replaceable filter foam material. In both vents, a louver opening is directed downward to prevent rain or water spray from entering. The fan need only keep the air inside the boat dry over the long term. The fan therefore may run continuously, or as power is available, e.g., during daylight when the sun is shining. In alternative embodiments, the pressurized air from the fan is valved through to inflate internal support chambers that will keep the cover away from the top surfaces of the boat even after the fan has stopped.

An advantage of the present invention is that a cover is provided that will help prevent rust and mildew inside a protective weather cover.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
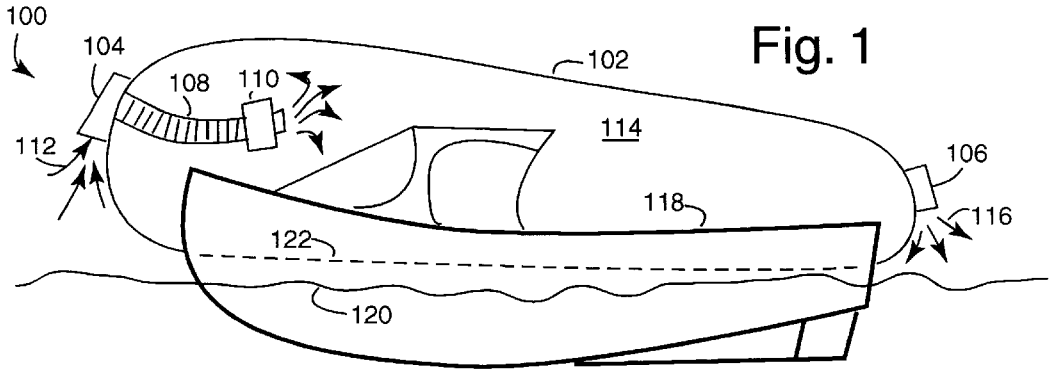
FIG. 1 is a diagram of a boat ventilator cover embodiment of the present invention in use on a boat sitting in water.

FIG. 1 illustrates a boat ventilator and cover system embodiment of the present invention, referred to herein by the reference numeral 100. The boat ventilator and cover system 100 comprises a fabric cover 102 fitted with an outside intake vent 104 and an exhaust vent 106. An air duct 108, which may be flexible, connects the intake vent 104 to a fan 110. The fan and the air duct are preferably arranged such that any water vapor that condenses inside does not drip on the boat. If desired, the air duct 108 can be eliminated so that the fan 110 is attached to the cover 102 opposite vent 104.

Outside, relatively dry air 112 is drawn in and forced inside to partially pressurize, inflate and ventilate the cover 102. The pressurized air 114 eventually is output through the exhaust vent 106 as an exhaust air 116. Of course, the pressurezed air 114 could also be naturally exhausted through any leakage between the cover 102 and the boat. The inflation, under internal pressure, of cover 102 is used to keep the fabric away from a protected boat 118 sitting in water up to a waterline 120. A bottom gather 122 to the cover is drawn snug by elastic or draw strings to secure the cover to the boat hull. The air-duct fan 110 is conventional and is powered by any available means, e.g., 110 VAC shore power, 12 VDC battery power on the boat, etc. A photovoltaic solar panel may also be used to provide power to the fan during daylight hours.

Figure 2:
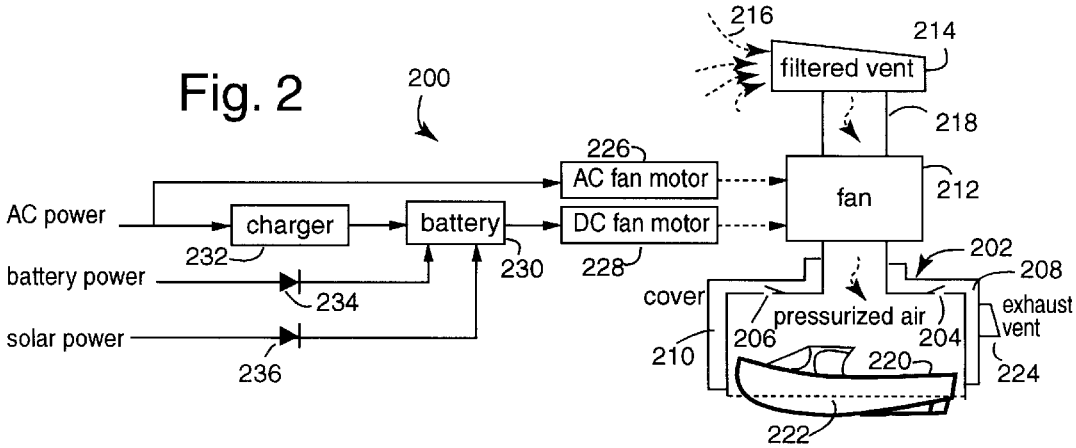
FIG. 2 is an electrical schematic diagram of the electrical power system for the fan motor and a mechanical schematic diagram of the air duct, fan, cover, and inflatable chambers of an alternative embodiment of the present invention.

FIG. 2 represents an alternative embodiment of the present invention. A boat ventilator and cover system 200 has a cover 202 fitted with a pair of chamber valves 204 and 206. Pressurized air inside the cover 202 will force its way through the valves 204 and 206 into a number of bow-support chambers 208 and 210. Such pressurized air is provided by a ventilation fan 212 by drawing in outside air through an air intake vent 214. Dry air 216 is drawn in and filtered and piped through an air duct 218.

The air trapped inside the bow-support chambers 208 and 210 will help keep the cover off the decks and top of a boat 220 sitting in the water. Such chambers and automatic valves are conventional in other applications, especially in air mattresses and recreational water toys and inflatable boats.

A bottom gather 222 seals the pressurized air inside the cover. An air exhaust vent 224 can be adjusted to let out trapped air at a controlled rate. In alternative embodiments of the present invention, an air exhaust vent is not used and pressurized air simply escapes through various unavoidable leaks in the sealing of the cover to the boat.

The fan 212 is rotated by either an AC motor 226 or a DC motor 228, according to what sort of power is available. It could also be mechanically driven by a windmill through a jackshaft.

A battery 230 can supply uninterrupted power to the DC fan motor 228. Such battery can be continuously or intermittently charged by an external DC power source or even photovoltaic solar panels. A battery charger 232 can provide battery recharging from a 110 VAC shore power hookup provided at many marina docks. The boat 220 need not be sitting in water, it could be stored inside a garage or carport at the user's home. In such situations, it is still very important to keep dry air circulating under the cover 202. A pair of silicon diodes 234 and 236 represent ways to isolate the power supplies from one another.

Figure 3:
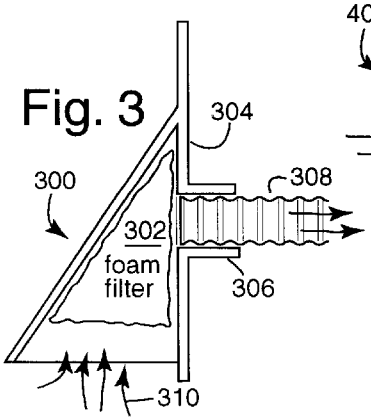
FIG. 3 is a cross-sectional diagram of an air intake vent similar to those shown in FIGS. 1 and 2.

FIG. 3 illustrates an air intake vent 300, e.g., as used in FIGS. 1 and 2. A wedge-shaped filter 302 of open-cell foam material is stuffed inside a compartment inside a vent housing 304. A pipe adapter 306 allows air to flow from the filter into a flexible air duct 308. An opening 310, e.g., a louver, is oriented during use to point downward so that the vent will shed rather than swallow rain water and snow. Such orientation is shown in FIG. 1 by vent 104 and air inflow 112. The vent housing 304 is preferably made of a non-corroding material, e.g., polyvinyl chloride (PVC) or polycarbonate (LEXAN). It would be particularly useful for the foam filter element 302 which is disposed in the air-intake vent 300 to be able to be installed and replaced through said open louver 310. A strap could be used to hold the filter inside.

Figure 4:
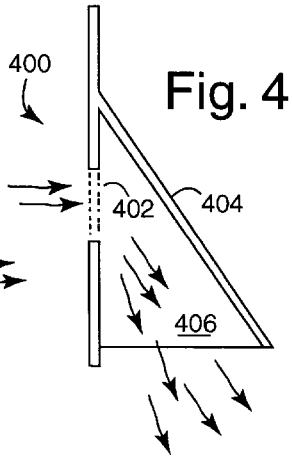
FIG. 4 is a cross-sectional diagram of an air exhaust vent similar to those shown in FIGS. 1 and 2.

FIG. 4 illustrates an air exhaust vent 400, e.g., as used in FIGS. 1 and 2. A screen 402 lines the inside of a compartment inside a vent housing 404. A pipe adapter is not needed. An opening 406 points down during use so that the vent will shed rain water and snow. Such orientation is shown in FIG. 1 by vent 106 and air outflow 116. The vent housing 404 is also preferably made of a plastic material like polyvinyl chloride (PVC) or polycarbonate (LEXAN). In alternative embodiments of the present invention, the screen 402 or its opening is made adjustable to control the flow of air through the cover.

Figure 5:
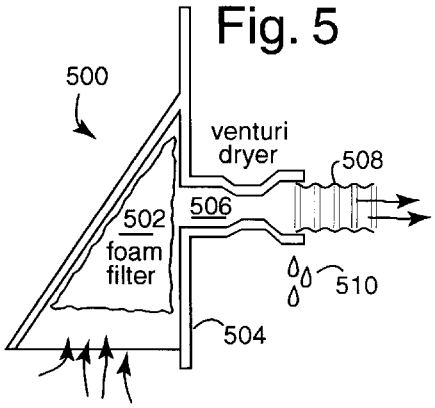
FIG. 5 is a cross-sectional diagram of an air intake vent with a venturi-tube air dryer that could be used in the systems of FIGS. 1 and 2.

FIG. 5 illustrates an air intake vent 500 that could be used in systems 100 and 200 of FIGS. 1 and 2. Incoming air is dried before being allowed inside the interior volume of the weather cover. A wedge-shaped filter 502 of open-cell foam material is stuffed inside a compartment inside a vent housing 504. A venturi tube 506 connects an air flow from the filter into a flexible air duct 508. Such air experiences pressure and temperature changes as it is drawn through the venturi tube. The combination of these changes forces water vapor carried by the air flow to drop out and condense. A condensation drip 510 is drained away, e.g., to the body of water the boat is sitting on.

In alternative embodiments of the present invention, a condensation or humidity detector is used to run the ventilation fan only when conditions inside the cover exceed some critical moisture threshold. It may also be advantageous to monitor the temperature of the boat and run the ventilation fan only when the dew point of the air is being approached. Water vapor will only condense on cold surfaces that are at a temperature less than the dew point. A retrofit kit embodiment of the present invention allows a user to convert an ordinary boat cover into the system described herein. Once converted, the result is as is described for system 100 (FIG. 1).

Although particular embodiments of the present invention have been described and illustrated, such is not intended to limit the invention. Modifications and charges will no doubt become apparent to those skilled in the art and it is intended that the invention only be limited by the scope of the appended claims.

What is claimed is:

1. A weather cover and ventilation system for a boat, comprising:

an air-pressurizable weather cover sized to fit completely over a boat and drape all around its hull sides;

a bottom gather that provides for an air seal between said boat above a waterline and a bottom edge of the draping sides of the cover;

an air-intake vent having an open louver and attached to the cover; and a fan mechanically connected to pump an airflow from the air-intake vent such that an interior volume of the cover is pressurized;

wherein, a flow of fresh outside air is used to reduce humidity and condensation within said cover that would otherwise damage said boat.

2. The weather cover and ventilation system of claim 1, wherein, said interior volume of the cover being pressurized holds an inside surface of the cover away from a top surface of said boat.

3. The weather cover and ventilation system of claim 1, further comprising:

an air-exhaust vent having an open louver and attached to the cover and providing for an outflow of pressurized air from said interior volume.

4. The weather cover and ventilation system of claim 3, wherein, the air-exhaust vent provides for a controlled release of said outflow of pressurized air from said interior volume.

5. The weather cover and ventilation system of claim 1, further comprising:

a fan motor connected to drive the fan and powered by at least one of AC shore power, DC battery power, and solar photovoltaic cells.

6. The weather cover and ventilation system of claim 1, further comprising:

a foam filter element disposed in the air-intake vent that can be installed and replaced through said open louver.

7. The weather cover and ventilation system of claim 1, further comprising:

a venturi tube disposed in the air intake vent and providing for a drying of any air drawn in by the fan.

8. The weather cover and ventilation system of claim 1, further comprising:

a flexible air duct that connects the air-intake vent to the fan.

* * * * *